US006338307B1

(12) United States Patent
Pires

(10) Patent No.: US 6,338,307 B1
(45) Date of Patent: Jan. 15, 2002

(54) OPEN PASSAGE WATER BALLAST TWIN HULL APPARATUS

(76) Inventor: Charles B. Pires, 123 Ahui St., Kewalo Shipyard, Honolulu, HI (US) 96813

( * ) Notice: Subject to any disclaimer, the term of this patent is extended or adjusted under 35 U.S.C. 154(b) by 0 days.

(21) Appl. No.: 09/678,230

(22) Filed: Oct. 4, 2000

(51) Int. Cl.[7] ..... B63B 1/00
(52) U.S. Cl. ..... 114/61.1; 114/61.2
(58) Field of Search ..... 114/61.1, 61.12, 114/61.13, 61.14, 61.2

(56) References Cited

U.S. PATENT DOCUMENTS 3,465,486 A * 9/1969 Rolin ..... 114/61.1
4,708,077 A * 11/1987 Balquet et al. ..... 114/61.2
4,936,237 A * 6/1990 Walters ..... 114/61.2

* cited by examiner

*Primary Examiner*—Stephen Avila
(74) *Attorney, Agent, or Firm*—Rodger H. Flagg

(57) ABSTRACT

A sea friendly hull shape invention provides the benefit of water ballast without the penalty of carrying that ballast. There are open ballast passages which can be in the shape of pipes, or other similar shapes, through which water flows continuously when the vessel is in motion or at rest. The passages are connected to a main hull by thin wave piercing hull shapes. As a wave passes under the vessel, there is little area presented to increase the hull's displacement and any hull movement up or down will be countered by the force of the water going through the ballast passages. In this manner there is a reaction similar to one offered by static ballast, but without the power demand needed to carry it.

16 Claims, 5 Drawing Sheets

OPEN PASSAGE WATER BALLAST TWIN HULL APPARATUS

BACKGROUND OF THE INVENTION

This invention relates to a waterborne twin hull vessel design, specifically to the improvement of hull stability and performance.

Vessel hull stability is dependent on the location relationship of the hull's center of buoyancy (displacement) and the loaded hull's center of gravity. The center of buoyancy is defined as the mathematical central point location of the water displaced by the hull's shape, and the center of gravity of the loaded hull is defined as the mathematical central point location of the weight of the hull together with its cargo. Both are measured along both the vertical and horizontal axis.

When a vessel is at rest or transitioning in calm water the center of gravity and center of buoyancy are in the same vertical position. When a wave hits the vessel, the change in displacement caused by the wave's form against the hull will shift the centers of gravity and buoyancy away from each other temporarily until a new equilibrium can be reached. On board the vessel this law of nature is experienced as a pitching or rolling motion. Under severe conditions, this can be very uncomfortable and may lead to sea sickness.

Another way to describe this phenomenon is that a vessel at rest in the water displaces the volume of water which equals its weight. When a vessel moves through the water and a wave passes against it, the height of this wave will ride up the sides of the vessel. At this point, the vessel displaces more water than it weighs, thus rising up in an effort to equalize its (vessel) weight with that of the water. Rising very quickly, it over compensates and finds itself not displacing enough water and descends back into the water. In rough seas this motion is repeated continuously in a violent manner.

The rising and falling of the waves along the sides of the vessel are called inches of immersion. For example, if a vessel displaces 1,000 pounds per inch of immersion, then a 12 inch or one foot wave will exert 12,000 pounds of lift on the vessel. The same is true with the trough of the wave as it recedes from the hull of the vessel. The craft will fall into the hole left by the receding wave.

The search for a vessel to tame the effect of the ocean waves has challenged man since the beginning of time. Vessel designers have continued to make advancements aimed at minimizing a wave's effect on hull motion. The easiest solution is to build a vessel large enough so that even a large wave will have a minimal influence on buoyancy. Other methods of approaching the problem include the design of submarines, hydrofoils, hovercrafts, ground effect crafts, catamarans, and swath vessels. Some of these vessels work very well at reducing the effect of ocean waves; however, some are cost prohibitive to build and operate.

Submarines, while on the surface of the ocean, are victims of the waves and swells of the ocean. However, once submerged beneath the surface, wave action is minimized. Unfortunately, submergence is not often a feasible method of water transportation due to factors related to practicality and cost effectiveness.

Hydrofoils are another alternative and have been around almost as long as the telephone. The United States Navy has spent considerable time and money on hydrofoils with limited success, but eventually abandoned its efforts due to the high cost of operation and maintenance.

Hovercrafts are still being pursued around the world and have yielded good results in calmer, sheltered waters of coastal zones. The hovercraft rides on a cushion of air which allows the waves to rise and fall between the surface of the body of water and the actual bottom of the vessel. However, once significant wave height has been exceeded, the ocean swells impact on the bottom of the hull producing violent movements.

Ground effect crafts have been used by European countries with some success. However, due to the large wing span of these crafts in addition to congested harbors and limited payload capacity in smaller versions of the crafts, ground effect crafts have not proven to be practical.

Catamarans are a very popular alternative for the ocean transportation industry. The success of catamarans or catamaran-type crafts vary greatly depending on the severity of the seas in which they operate. In a catamaran, twin hulls having narrow cross sections where wave contact is anticipated are designed so that the added hull buoyancy caused by waves will be minimized. The catamaran is attractive because of its simplistic design, high speed capability, fuel efficiency, and low cost of maintenance and operation. Unfortunately, the catamaran is generally unable to produce the same ride quality of some of the crafts described above. Furthermore, due to its resulting low displacement hull, cargo carrying capacity is restricted.

The swath vessel, a relative of the catamaran, has a small water-plane area twin hull or swath design with the twin hulls of the catamaran, torpedo shaped displacement chambers of a submarine, and the fins of a hydrofoil. This type of vessel has the ability to deliver a good quality ride while operating in choppy seas. Due to the significant reduction in pitching and rolling, sea sickness is virtually eliminated. As a light ship the swath vessel floats on its torpedo shaped hulls. The vessel's torpedo hulls are partially or fully flooded with water, weighing the vessel down to its designed water line. The vessel is then supported by the remaining buoyancy in the torpedo hulls in addition to the added buoyancy of the catamaran hulls. Due to the long, narrow width of the catamaran hulls, the pounds per inch of immersion are low while the weight below the surface of the water is high and completely unbalanced. If the vessel displaces 1,000 pounds per inch of immersion, this unbalanced condition would permit the vessel to push through a one foot wave with 12,000 pounds of lift. This force is counter-balanced by the water ballast in the torpedo, resulting in slower vertical acceleration of the vessel and a good quality ride. Unfortunately, a good quality ride is provided at the expense of a good power to weight ratio. Although an uneconomical power to weight ratio is not a critical problem at low speeds, for high speed applications the power required to push the vessel and the accompanying weight of the water ballast becomes very costly with respect to fuel and machinery. Consequently, few swath-type high speed vessels are in current operation due to this problem.

U.S. Pat. No. 5,325,804 issuing to Schneider on Jul. 5, 1994 discloses a watercraft having twin submarine hulls supported by stanchions which extend between the cabin and the submarine hulls. The motor is supported by swing bars which raise and lower the engine.

U.S. Pat. No. 4,541,356 issuing to Jone on Sep. 17, 1985 discloses a multi-hull vessel having first and second tubes extending from a center keel, with outriggers extending on each side of the central hull.

U.S. Pat. No. 3,481,296 issuing to Stephens on Dec. 2, 1969, discloses a vessel having water ballast ducts in catamaran type pontoons. The flow of air and water is controlled by gates located at the bow and stem.

U.S. Pat. No. 1,444,150 issuing to Gadowski on Feb. 6, 1923 discloses a ship's hull having a water passage on each side wall of the hull at a location beneath the waterline, to aid in stabilizing the vessel.

SUMMARY OF THE INVENTION

It is therefore an object of the invention to provide an improved vessel hull design incorporating a continuous flow ballast system design for countering dynamic wave forces.

It is also an object of the invention to provide an improved vessel hull design that enables a good quality ride on a body of water in both high and low speed applications in a cost-effective manner.

It is also an object of the invention to provide an improved vessel hull design that enables efficient and relatively low cost operation and maintenance of the vessel.

In the broader aspects of the invention, this sea friendly hull shape invention provides the benefit of water ballast without the penalty of carrying that ballast. There are open ballast passages which can be in the shape of pipes, or other similar shapes, through which water flows continuously when the vessel is in motion or at rest. The passages are connected to a main hull by thin wave piercing hull shapes. As a wave passes under the vessel, there is little area presented to increase the hull's displacement and any hull movement up or down will be countered by the force of the water going through the ballast passages. In this manner there is a reaction similar to one offered by static ballast, but without the power demand needed to carry it.

BRIEF DESCRIPTION OF THE DRAWINGS

The above-mentioned and other features and objects of the invention and the manner of attaining them will become more apparent and the invention itself will be better understood by reference to the following description of embodiments of the invention taken in conjunction with the accompanying drawings wherein.

DETAILED DESCRIPTION OF THE PREFERRED EMBODIMENT

Figure 1:
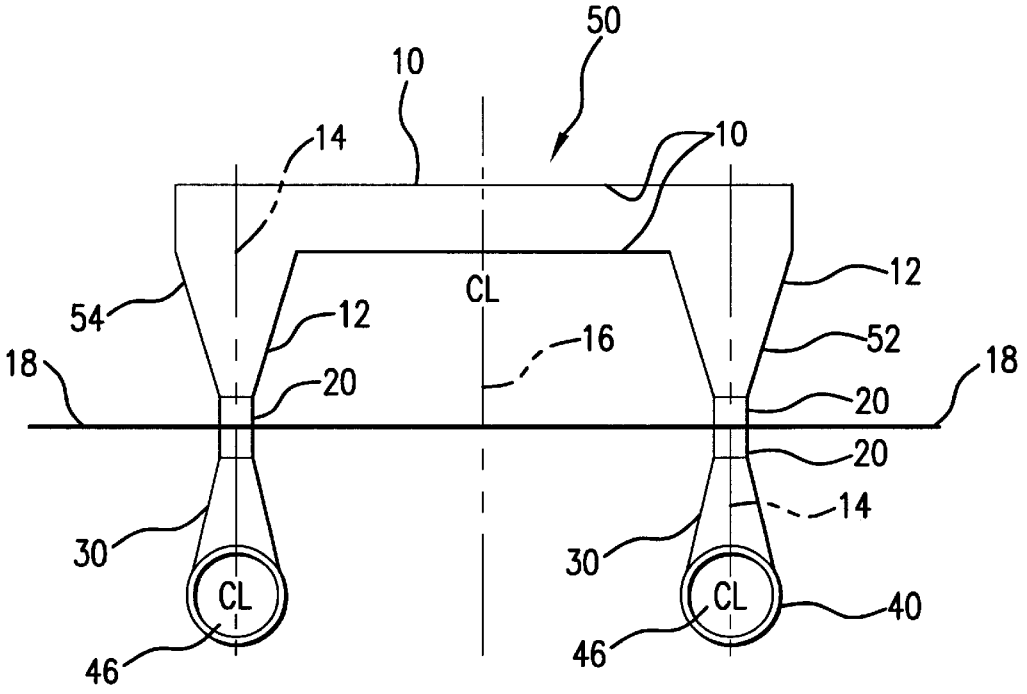
FIG. 1 is a front view showing the improved hull design incorporating the open passage water ballast design according to a preferred embodiment of the present invention.
Figure 2:
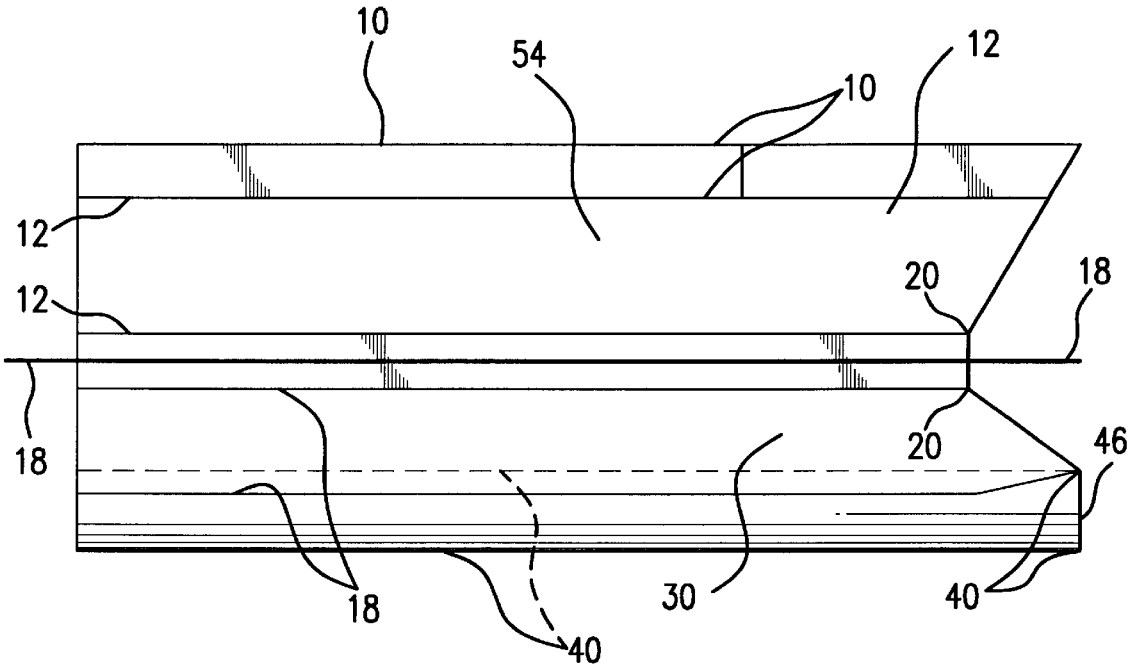
FIG. 2 is a side sectional view taken at a hull center line of the improved hull design.

Referring now to the drawings FIG. 1 through FIG. 7, wherein like reference numerals refer to like parts, there is shown a twin-hull vessel apparatus 50, which has an inverted "U" configuration that is symmetrical about a vessel center line 16 that extends vertically through the vessel through its midpoint and is perpendicular to the water line 18. The twin-hull vessel apparatus 50 includes three main components, including a cross deck 10 forming the top of the inverted "U", and also forming a plane that is parallel to water line 18, and first and second hulls 52 and 54 secured on opposite sides of the cross deck 10. The first and second hulls 52, 54 extend vertically downwards away from the cross deck 10 into the water to form the spaced, parallel edges of the inverted "U" shape configuration.

Figure 5:
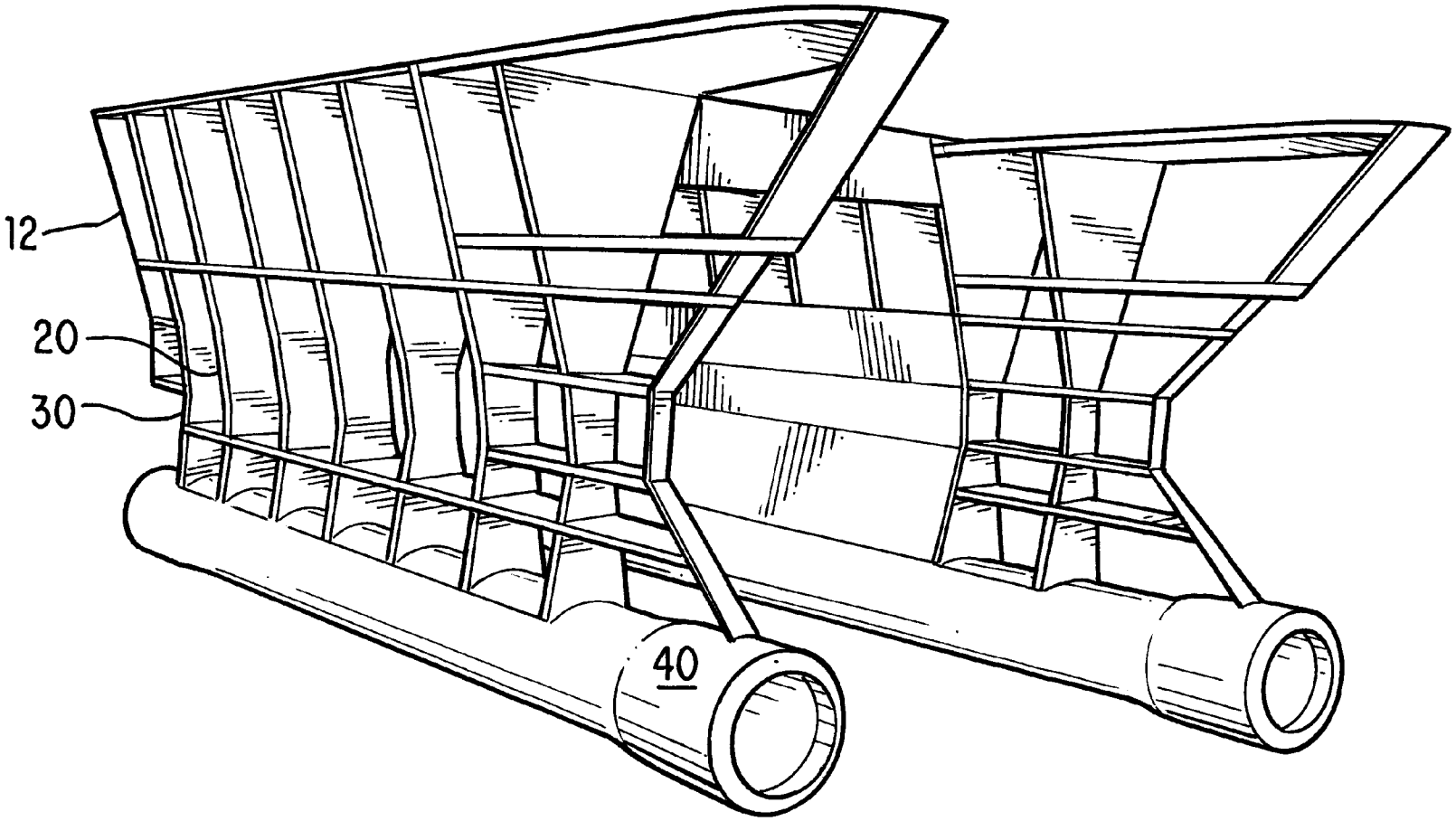
FIG. 5 is a perspective view showing an embodiment, showing the hollow tubes secured to the boat hull framework.

As shown in FIG. 5, the framework of each of the twin hulls 52 and 54 includes an upper inclined hull portion 12, which is secured to the cross deck 10, a wave impact hull portion 20 that is secured to the inclined hull portion in proximity to the water line 18, and a lower buoyancy hull portion 30, which is secured to the wave impact hull portion 20, and is submerged under the water line 18 during normal operation. The first and second hulls 52 and 54 are symmetrical about a hull center line 14, which extends vertically through each hull through its midpoint and is perpendicular to the plane of the cross deck 10. Ideally, an upper hull portion 12, wave impact hull portion 20, and lower buoyancy hull portion 30 of each of the first and second hulls 52 and 54 should be designed to be thin, wave piercing hull shapes. Other design considerations may be accounted for in accordance with conventional principles for vessel hull design known by those of ordinary skill in the art.

Figure 6:
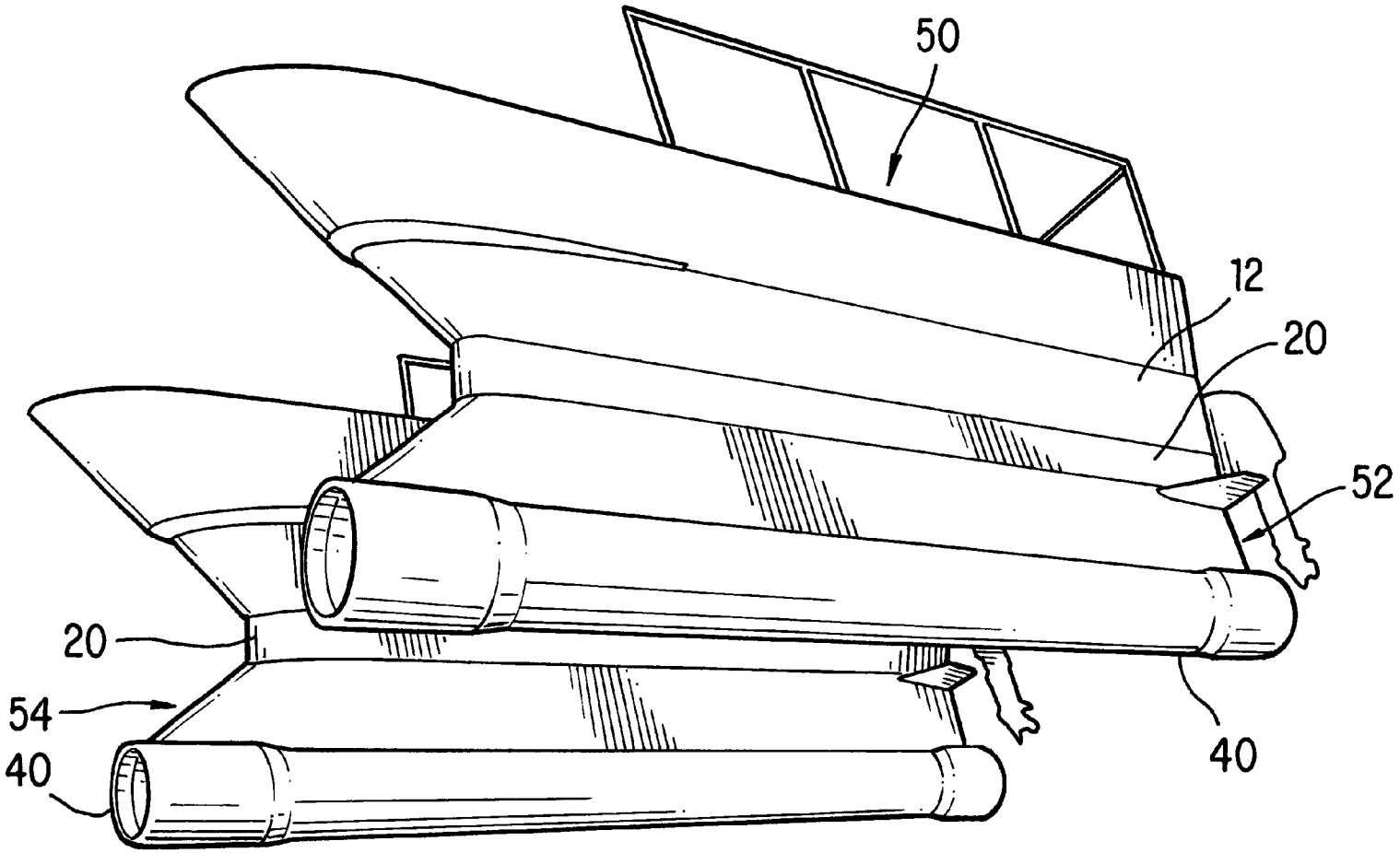
FIG. 6 is a perspective view of the boat hull raised above the water.

The twin boat hull vessel apparatus 50 is shown raised from the water in FIG. 6.

Figure 3:
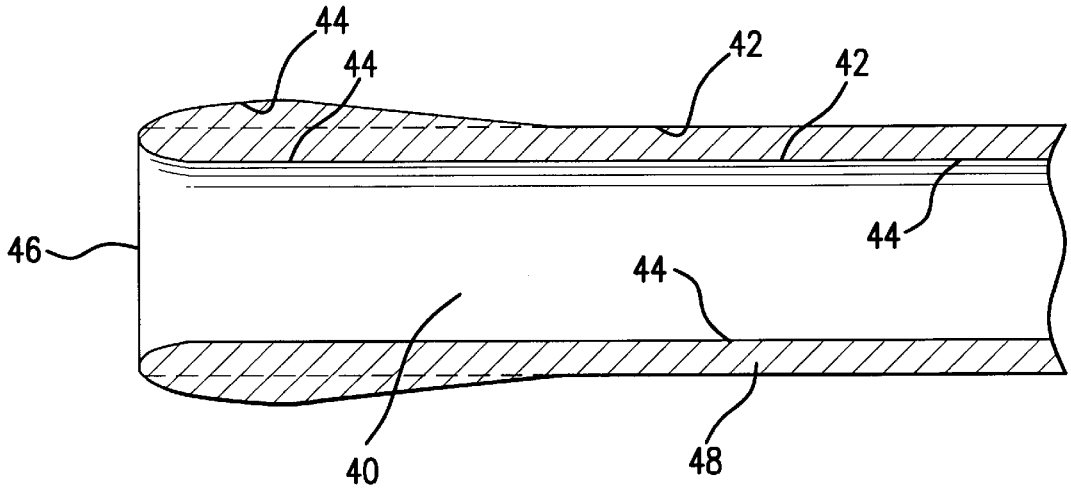
FIG. 3 is a side sectional view of the open pipe, showing the increased wall thickness near the front end of the open pipe configuration.

Secured below lower buoyancy hull 30 of each of the twin hulls 52 and 54 is an open pipe conduit 40, which extends horizontally over the length of lower buoyancy hull 30 in a direction parallel to the direction of propulsion of twin hull vessel 50. As shown in FIG. 3. open pipe conduit 40 is annular in shape with both ends open. The inner diameter of the open pipe conduit 40 is substantially uniform throughout its length. The open pipe conduit 40 and has a first wall thickness 42 which increases to a second wall thickness 43 near pipe nozzle 46, which is located at one end of open pipe conduit 40 and serves as the inlet for water passage through open pipe conduit 40. Propulsion of vessel 50 may be achieved through one of many known, conventional means.

Figure 4:
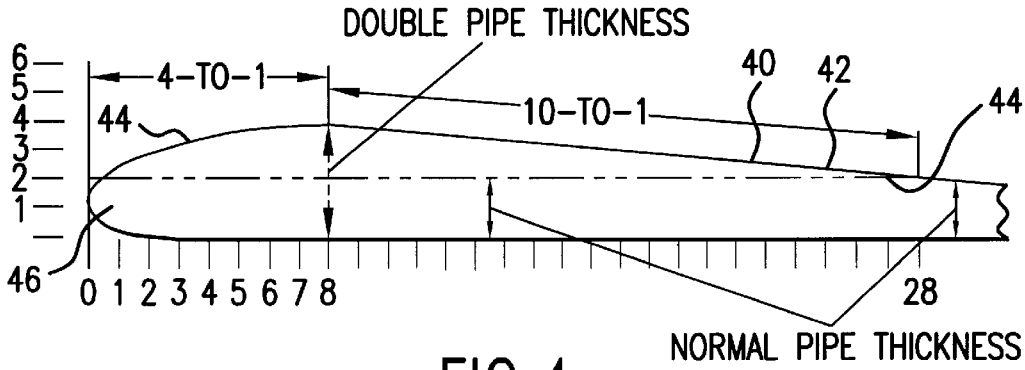
FIG. 4 is a diagram showing the design of the pipe nozzle at the inlet.

The design of pipe nozzle 46 has been challenging in concept and has been a problem area in design due to high speed cavitation or aeration of the inlet of nozzle 46 as speed increases and during periods when open pipe conduit 40 breaks through the surface of the water. As a result of research and empirical studies, the inventors have determined that cavitation problems may be avoided, thereby providing for enhanced flow characteristics into the open pipe conduit 40, by "bulbing" the thickness of pipe 40 near the inlet of nozzle 46. Specifically, as shown in FIG. 4, optimum results may be attained by doubling normal pipe thickness near nozzle 46 over the length of open pipe conduit 40 at the rate of 4 to 1, then reduction of the "bulbed" thickness to the normal pipe thickness at the rate of 10 to 1.

Figure 7:
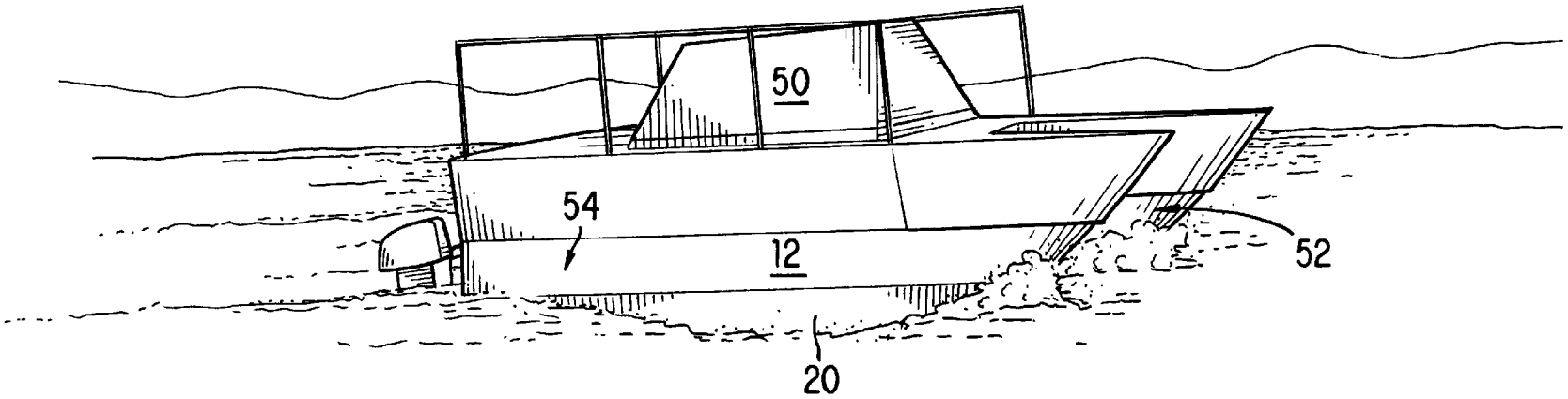
FIG. 7 is a perspective view of the boat hull underway in water.

During operation, as shown in FIG. 7, as the vessel is propelled through the water, water enters open pipe conduit 40, which is secured to each of the first and second hulls 52 and 54, through pipe nozzle 46 and exits at the rear end of the open pipe conduit 40. A continuous flow of water passes through the open pipe conduit 40 since the open pipe conduit 40 is submerged under the water line 18. Due to the design of the pipe nozzle 46, problems related to high speed cavitation or aeration of the inlet of the pipe nozzle 46 can be avoided.

The water passing through the open pipe conduit 40 passes with little friction in the horizontal direction. Additionally, the first and second hulls 52 and 54, each comprise an upper hull portion 12, wave impact hull portion 20, and lower buoyancy hull portion 30, which are designed to be thin, wave piercing hull shapes so as not to add significant additional buoyancy or drag to the twin hull vessel 50. The weight of the water in the open pipe conduit 40 serves as a ballast counter-force in the downward vertical direction against the upward lift force caused by waves rushing against the first and second vessel hulls 52, 54. This results in a smoother ride in choppy waters or at high speeds. Furthermore, since the water continuously passes through the open pipe conduit 40, the invention provides similar advantages offered by static ballast systems, but without the power demand needed to carry the weight of the water.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto.

What is claimed is:

1. A twin-hull vessel apparatus, comprising:

a cross deck;

first and second hulls secured to the cross deck in spaced relation, each of the first and second hulls extending downward from the cross deck into a surface of a body of water, each of the first and second hulls further having an upper hull portion secured to the cross deck, a wave impact hull portion secured to the upper hull portion in proximity to the waterline, and a lower buoyancy hull portion secured to the wave impact hull portion at a location below the waterline;

an open pipe conduit secured to each of the lower buoyancy hull portions, said open pipe conduits each having open front and back ends, said front end serving as an inlet nozzle for water passage through the open pipe conduit, said open pipe conduit extending horizontally in a direction parallel to a direction of propulsion of the multi-hull vessel;

the upper hull portion tapers inwardly on each side about a hull centerline towards the wave impact hull portion, and the lower buoyancy hull tapers outwardly on each side about the hull centerline from the wave impact hull portion to the open pipe conduit; and said upper hull, wave impact hull, and lower buoyancy hull are designed as thin, wave piercing hull shapes.

2. The twin-hull vessel apparatus of claim 1, wherein said open pipe conduit is secured to each of the first and second hulls at a location below the lower buoyancy hull portion, said open pipe conduit extending horizontally over the length of the lower buoyancy hull in a direction parallel to a direction of propulsion of the twin-hull vessel.

3. The twin-hull vessel apparatus of claim 1, wherein said open pipe conduit has a varying wall thickness with a uniform diameter along the length of the open pipe conduit, the wall thickness of the open pipe conduit being greater at and near the front end of said open pipe conduit relative to the thickness and diameter at the back end.

4. The twin-hull vessel apparatus of claim 1, wherein the open pipe conduit wall thickness at and near the front end gradually increases at a rate of 4 to 1 along the length of the open pipe conduit, beginning at the front end of the open pipe conduit and extending towards the back end, reaching a maximum thickness of two times the thickness of the open pipe conduit, and then gradually decreases in thickness at a rate of 10 to 1 along the remaining length of the open pipe conduit until the thickness of the open pipe conduit reaches the thickness of the open pipe conduit at the back end.

5. A twin-hull vessel apparatus, comprising:

a cross deck having a cabin secured thereon;

first and second hulls secured in spaced relation to the cross deck, each of the first and second hulls extending downward from the cross deck into a surface of a body of water, each of the first and second hulls further having an upper hull portion secured to the cross deck, a wave impact hull portion secured to the upper hull portion in proximity to the waterline, and a lower buoyancy hull portion secured to the wave impact hull portion at a location below the waterline;

an open pipe conduit secured to each of the first and second hulls, said open pipe conduits each having open front and back ends, said front end serving as an inlet nozzle for water passage through the open pipe conduit, said open pipe conduit extending horizontally in a direction parallel to a direction of propulsion of the twin-hull vessel apparatus; and said open pipe conduit has a varying wall thickness and a uniform inner diameter along the length of the open pipe conduit, the wall thickness being greater at and near the front end of said open pipe conduit relative to the thickness and diameter at the back end.

6. The twin-hull vessel apparatus of claim 5, wherein the wall thickness of said open pipe conduit at and near the front end gradually increases at a rate of 4 to 1 along the length of the open pipe conduit, beginning at the front end of the open pipe conduit and extending towards the back end, reaching a maximum thickness of two times the thickness of the open pipe conduit, and then gradually decreases in thickness at a rate of 10 to 1 along the remaining length of the open pipe conduit until the thickness of the open pipe conduit reaches the thickness of the open pipe conduit at the back end.

7. The twin-hull vessel apparatus of claim 5, wherein each upper hull portion tapers inwardly on each side about a hull centerline towards the wave impact hull portion, and the lower buoyancy hull tapers outwardly on each side about the hull centerline from the wave impact hull portion to the open pipe conduit.

8. The twin-hull vessel apparatus of claim 5, wherein said upper hull, wave impact hull, and lower buoyancy hull are designed as thin, wave piercing hull shapes.

9. The twin-hull vessel apparatus of claim 5, wherein said open pipe conduit is secured to each of the first and second hulls at a location below the lower buoyancy hull, said open pipe conduit extending horizontally over the length of the lower buoyancy hull in a direction parallel to a direction of propulsion of the multi-hull vessel.

10. The twin-hull vessel apparatus of claim 5, wherein said open pipe conduit is annular in shape.

11. A twin-hull vessel apparatus, comprising:

a cross deck;

a first hull and a second hull secured in spaced relation to the cross deck, each of the first and second hulls having an upper hull portion secured to the cross deck, a wave impact hull portion secured to the upper hull portion in proximity above the waterline, and a lower buoyancy hull portion secured to the wave impact hull portion below the waterline;

an open pipe conduit secured to the lower buoyancy hull portion, each open pipe conduit having open front and back ends, said front end serving as an inlet nozzle for water passage through the open pipe conduit, said open pipe conduit extending horizontally in a direction parallel to a direction of propulsion of the twin-hull apparatus; and said open pipe conduit having a uniform annular diameter extending along the length of the open pipe conduit, the wall thickness of said open pipe conduit at and near the front end gradually increases at a rate of 4 to 1 along the length of the open pipe conduit, beginning at the front end of the open pipe conduit and extending towards the back end, reaching a maximum thickness of two times the wall thickness of the open pipe conduit, and then gradually decreases in wall thickness at a rate of 10 to 1 along the remaining length of the open pipe conduit until the thickness of the open pipe conduit reaches the thickness of the open pipe conduit at the back end.

12. The twin-hull vessel apparatus of claim 11, wherein the upper hull portion tapers inwardly on each side about a hull centerline towards the wave impact hull portion, and the lower buoyancy hull tapers outwardly on each side about the hull centerline from the wave impact hull portion to the open pipe.

13. The twin-hull vessel apparatus of claim 11, wherein said upper hull, wave impact hull, and lower buoyancy hull are designed as thin, wave piercing hull shapes.

14. The twin-hull vessel apparatus of claim 11 wherein said open pipe conduit is secured to each of the first and second hulls at a location below the lower buoyancy hull, said open pipe conduit extending horizontally over the length of the lower buoyancy hull in a direction parallel to a direction of propulsion of the twin-hull vessel.

15. The twin-hull vessel apparatus of claim 11, wherein said open pipe conduit is annular in shape.

16. The twin-hull vessel apparatus of claim 11, wherein a cabin is secured to the cross deck.

* * * * *